US009976800B2

(12) United States Patent
Kempfle

(10) Patent No.: US 9,976,800 B2
(45) Date of Patent: May 22, 2018

(54) REFRIGERATION APPLIANCE WITH A PRESSURE SENSOR

(71) Applicant: BSH HAUSGERAETE GMBH, Munich (DE)

(72) Inventor: Stephan Kempfle, Ellzee (DE)

(73) Assignee: BSH Hausgeraete GmbH, Munich (DE)

( * ) Notice: Subject to any disclaimer, the term of this patent is extended or adjusted under 35 U.S.C. 154(b) by 0 days. days.

(21) Appl. No.: 15/191,706

(22) Filed: Jun. 24, 2016

(65) Prior Publication Data

US 2016/0377339 A1 Dec. 29, 2016

(30) Foreign Application Priority Data

Jun. 26, 2015 (DE) ..... 10 2015 211 958
Aug. 13, 2015 (DE) ..... 10 2015 215 487

(51) Int. Cl.
*F25D 23/06* (2006.01)
*F25D 29/00* (2006.01)
*F25D 23/02* (2006.01)

(52) U.S. Cl.
CPC ..... *F25D 29/005* (2013.01); *F25D 23/068* (2013.01); *F25D 23/028* (2013.01); *F25D 2700/02* (2013.01)

(58) Field of Classification Search
CPC ..... F25D 23/068; F25D 29/005
USPC ..... 312/401, 406, 406.1; 62/440
See application file for complete search history.

(56) References Cited

U.S. PATENT DOCUMENTS

| | | | | |
|---|---|---|---|---|
| 3,311,045 | A | 3/1967 | Constantini et al. | |
| 5,806,575 | A | 9/1998 | Tsay | |
| 2009/0045203 | A1* | 2/2009 | Ehrlich | E05G 1/02 220/592.01 |
| 2009/0266095 | A1* | 10/2009 | Pruneri | A23L 3/3418 62/231 |
| 2013/0036755 | A1* | 2/2013 | Kang | B01L 1/50 62/129 |
| 2016/0116206 | A1 | 4/2016 | Kempfle et al. | |
| 2016/0363364 | A1 | 12/2016 | Kempfle | |

FOREIGN PATENT DOCUMENTS

| | | | |
|---|---|---|---|
| CN | 101865584 | A | 10/2010 |
| DE | 4403336 | A1 | 11/1994 |
| DE | 69215061 | T2 | 4/1997 |
| DE | 102011006256 | A1 | 10/2012 |
| DE | 102011077824 | A1 | 12/2012 |
| DE | 102013211103 | A1 | 12/2014 |
| EP | 2527767 | A2 | 11/2012 |
| IT | 1299392 | B1 | 3/2000 |
| JP | 3637311 | B2 | 4/2005 |

(Continued)

*Primary Examiner* — James O Hansen
(74) *Attorney, Agent, or Firm* — Laurence A. Greenberg; Werner H. Stemer; Ralph E. Locher

(57) ABSTRACT

A refrigeration appliance, in particular a domestic refrigeration appliance, includes a storage chamber delimited by an inner container and a pressure sensor disposed outside the storage chamber. The pressure sensor communicates with the storage chamber by way of a connection housing anchored in an opening of a wall surface of the inner container. An exposed surface of the connection housing facing the storage chamber is flush with the surrounding wall surface.

11 Claims, 3 Drawing Sheets

(56) References Cited

FOREIGN PATENT DOCUMENTS

| | | | |
|---|---|---|---|
| WO | 0153763 | A1 | 7/2001 |
| WO | 2012130637 | A2 | 10/2012 |
| WO | 2012175367 | A2 | 12/2012 |
| WO | 2015128165 | A1 | 9/2015 |

* cited by examiner

REFRIGERATION APPLIANCE WITH A PRESSURE SENSOR

CROSS-REFERENCE TO RELATED APPLICATION

This application claims the priority, under 35 U.S.C. § 119, of German Patent Application DE 10 2015 215 487.4, filed Aug. 13, 2015 and of German Patent Application DE 10 2015 211 958.0, filed Jun. 26, 2015; the prior applications are herewith incorporated by reference in their entirety.

BACKGROUND OF THE INVENTION

Field of the Invention

The present invention relates to a refrigeration appliance, in particular a domestic refrigeration appliance, with a storage chamber delimited by an inner container and a pressure sensor which, although it is disposed outside the storage chamber, communicates with the latter by way of a connection housing which is anchored in an opening of a wall surface of the inner container.

A refrigeration appliance, for which such a pressure sensor is used to record pressure fluctuations which arise during operation of the door of the refrigeration appliance by a user and a door opening aid, is activated when the pressure fluctuations indicate that a user is in the process of opening the door, as is known from German Patent Application DE 10 2013 211 103 A1, corresponding to U.S. Patent Application US 2016/0116206.

The connection housing of that known refrigeration appliance is roughly rectangular in shape and is inserted from outside through an opening of a wall surface of the inner container until shaped catching projections have completely passed the opening in the walls of the backing piece and engage on an inner surface of the inner container while at the same time an apron protruding circumferentially from the connection housing fits closely in an elastically deformed manner against the outside of the inner container.

As a result, part of the connection housing necessarily projects into the storage chamber and forms a disturbing foreign body therein.

SUMMARY OF THE INVENTION

It is accordingly an object of the invention to provide a refrigeration appliance with a pressure sensor, which overcomes the hereinafore-mentioned disadvantages of the heretofore-known appliances of this general type and which minimizes fittings that restrict the usability of a storage chamber.

With the foregoing and other objects in view there is provided, in accordance with the invention, a refrigeration appliance comprising a storage chamber delimited by an inner container and a pressure sensor disposed outside the storage chamber which communicates with the storage chamber by way of a connection housing anchored in an opening of a wall surface of the inner container, in which an exposed surface of the connection housing facing the storage chamber is flush with the surrounding wall surface.

The pressure sensor should be disposed outside a layer of insulation material surrounding the inner container in order to be accessible in the event of a fault and to enable replacement, if necessary.

The connection housing can be divided into a pressure sensor part and an inner container part by using a deflectable membrane. Although the membrane is able to relay pressure fluctuations arising in the storage chamber to the pressure sensor as a result of its deflectability, impurities or condensate which might impair the functional capability of the pressure sensor are kept away from the pressure sensor by the membrane.

Preferably the border area surrounding the opening is sunk into the wall surface of the inner container. Form-locking anchorage of the connection housing on an inner surface of the inner container is thus possible without the connection housing having to project over the surrounding wall surface into the storage chamber for this purpose.

A gap by way of which the pressure sensor communicates with the storage chamber can then be delimited on one hand by the border area and on the other hand by a cover of the connection housing which also forms its exposed surface.

The connection housing may further include a backing piece which engages in a layer of insulation material surrounding the inner container and is connected to a pipe communicating with the pressure sensor.

The pipe emanating from the backing piece should, at least if the connection housing has no membrane, extend upwards to prevent the penetration of liquid or dirt into the pipe from the backing piece.

The pipe can be fastened to a connection nozzle of the backing piece by using an insertion cartridge.

Preferably, the connection housing is anchored in the opening by using a bayonet coupling. The bayonet coupling can be allocated to the connection housing and the border area. However, connecting the two areas to each other by way of a bayonet coupling allocated to the backing piece and the cover in such a way that they locate the border area between them is also conceivable.

The opening of the inner container preferably includes a circular central area through which a cylindrical pipe section of the connection housing, preferably of the backing piece, extends, and at least one protrusion through which a crosspiece of the bayonet coupling which protrudes outwards radially from the pipe section and extends in the peripheral direction of the pipe section can be passed in order to overlap the border area with the bayonet coupling in a locked position. At least during the assembly of the refrigeration appliance, before the layer of insulation material has been completed and embeds the connection housing inflexibly, it can be rotated on its axis in the opening to lock and unlock the bayonet coupling.

The bayonet coupling may in particular include at least two crosspieces of the cylindrical pipe section protruding outwards radially, separated from each other by gaps in the peripheral direction of the pipe section. In order to be able to clearly establish the direction of the connection housing (or its backing piece) in which the pipe section can be inserted in the direction of its longitudinal axis through the opening of the inner container, the dimensions of the crosspieces may differ in a radial direction and/or in a peripheral direction, or the dimensions of the gaps may differ in a peripheral direction.

In particular, the opening may include at least two protrusions emanating from the central area of which at least one is measured or dimensioned to allow only one of the two crosspieces through in the direction of the longitudinal axis of the pipe section.

Since the cover protrudes in a radial direction over the cylindrical pipe section, it may conceal the bayonet coupling and prevent dirt from getting caught in the bayonet coupling when the inner container wall is wiped. Since the cover completely conceals the opening, the requirements for the dimensional accuracy of the opening may be considerably lower than in the aforementioned refrigeration appliance known from German Patent Application DE 10 2013 211 103 A1, corresponding to U.S. Patent Application US 2016/0116206.

Since the orientation of the backing piece on the inner container wall is clearly established, it may be ensured that a connection by way of which the backing piece communicates with the pressure sensor passes upwards from the backing piece so that an impurity or moisture which potentially enters into the backing piece from the storage chamber cannot advance into the connection and block it or otherwise falsify the pressure recorded by the pressure sensor.

The backing piece should have a peripheral apron which is elastically deformed in contact with an external side of the inner container. Such an apron on one hand serves as a seal which prevents the advance of insulation material into the storage chamber through joins or joints between the edge of the opening and the backing piece incorporated therein and on the other hand the tension of the apron ensures the sufficiently rigid, play-free fit of the backing piece on the inner container even before the installation of the layer of insulation material and thus makes the assembly of the refrigeration appliance easier.

Other features which are considered as characteristic for the invention are set forth in the appended claims.

Although the invention is illustrated and described herein as embodied in a refrigeration appliance with a pressure sensor, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
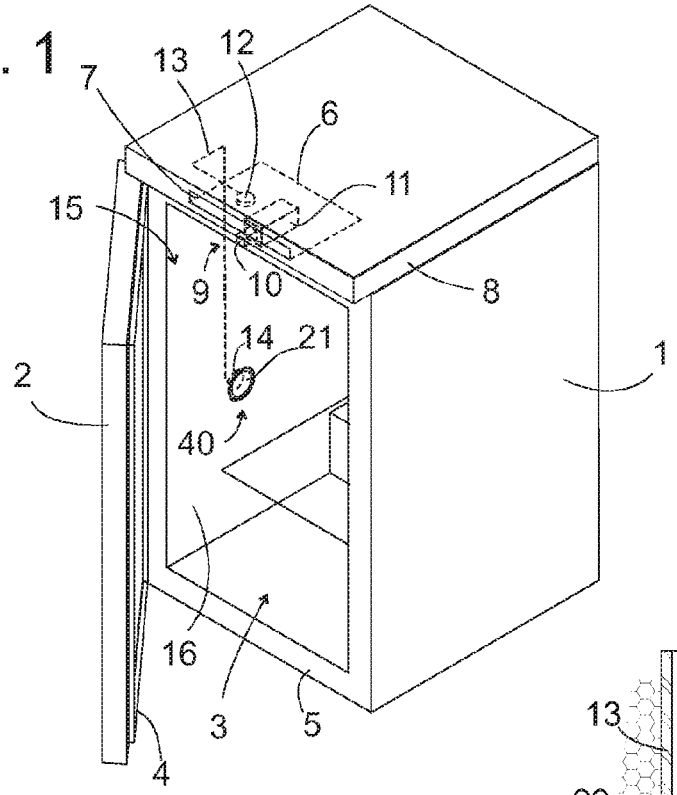
FIG. 1 is a diagrammatic, perspective view of a domestic refrigeration appliance according to the invention.

Referring now to the figures of the drawings in detail and first, particularly, to FIG. 1 thereof, there is seen a diagrammatic view of a domestic refrigeration appliance with a door opening aid according to the present invention. A floor-standing refrigerator is shown but on the basis of the following description it should be clear to a person skilled in the art that the invention is also readily transferable to other types of refrigeration appliance.

A heat-insulating housing of the refrigerator includes a body 1 and a door 2 hinged thereto, which is shown in this case in a partially open position so that a storage chamber 3 in the interior of the body 1 is also visible. A magnetic seal 4 is disposed on an inner surface of the door 2 facing the body 1 in the usual way, so that the magnetic seal 4 forms a hermetic seal with an anterior frame 5 extending around the storage chamber 3 of the body 1 when the door 2 is in the closed position.

An electronic circuit board 6 on which various circuits are disposed for controlling the operation of the refrigerator and for making its operating status visible is housed in this case in a recess of a layer of insulation material of rigid foam filling the walls of the body 1 behind an operating and display panel 7. In the floor-mounted appliance shown herein, the operating and display panel 7 is inserted into the upper edge of a worktop 8 forming the upper side of the body 1, whereas in other types of appliance it might be found in the frame 5, preferably in an area of the frame 5 which is not concealed by the door 2 when the door is closed and can thus be readily accessed and seen by a user.

A door opening aid 9 is fitted on the electronic circuit board 6, in this case on its underside. The door opening aid 9 includes an electric actuator 11 and a damper 10 extendible from an opening of the frame 5 under the control of the actuator 11. FIG. 1 shows this damper 10 projecting over the frame 5 in an extended position in which it would withdraw the magnetic seal 4 locally from the frame 5 and thus enable pressure compensation between the storage chamber 3 and the surroundings when the door 2 is closed.

The actuator 11 is controlled by a pressure sensor 12, preferably a differential pressure sensor, which is likewise disposed on the electronic circuit board 6. Since the recess of the insulation material in which the electronic circuit board 6 is accommodated communicates with the surroundings by way of various joins or joints, one of two pressure connections of the differential pressure sensor 12 can discharge directly into the recess in order to include or encompass the ambient pressure. A second connection of the differential pressure sensor 12 is connected to a backing piece 14 by way of a pipe 13 extending through the insulation material of the body 1. The backing piece 14 is installed in a side wall of the body 1 and together with a cover 21 behind which it is hidden in the diagram in FIG. 1, the backing piece 14 forms a connection housing 40 by way of which the pipe 13 communicates with the storage chamber 3.

In the usual way, the body 1 includes an inner container 15 of thermoformed plastic which forms the substantially flat wall surfaces bounding the anterior frame 5 and the storage chamber 3 on five sides. An opening in which the backing piece 14 is installed is cut in one of these wall surfaces 16.

Figure 2:
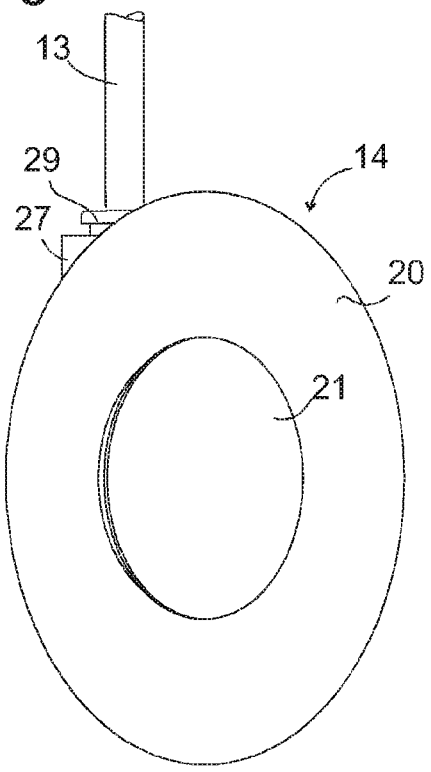
FIG. 2 is a perspective view of a backing piece.

FIG. 2 shows the backing piece 14 with the cover 21 installed thereon in an enlarged perspective view. As is clear in FIG. 3, the plastic backing piece 14, which is injection-molded in one piece, includes a flat pan 17 open in the direction of the storage chamber 3, the edge of which facing the storage chamber 3 is formed by a cylindrical pipe section 18 of a few mm in length. The pipe section 18 is inserted from the outside through an opening 19 of the wall surface 16 so far that a thin-walled, elastic apron 20 protruding from around the pan 17 forms a hermetic seal on the external side of the wall surface 16 and is deformed in contact therewith. The cover 21 is inserted into the pan 17 from the inside of the wall surface 16 and anchored in this case, for example, with the aid of two pins 22 which protrude from a reverse side of the cover 21 into the pan 17 and engage frictionally in grooves 23 in the walls of the pan 17. The cover 21 is circular like the pipe section 18 but has a larger diameter than the latter so that it completely conceals the pipe section 18 and the opening 19 through which it extends. The penetration depth of the pins 22 into the pan 17 is so limited that a gap 24 remains open between the reverse side of the cover 21 and the pipe section 18 by way of which the interior of the pan 17 communicates with the storage chamber 3.

A border area 25 of the inner container 15 surrounding the opening 19 is sunk into the wall of the storage chamber to form a flat recess which houses the cover 21 so that the external side of the cover 21 is flush with the internal side of the wall surface 16 surrounding the border area 25.

The pan 17 has a base plate 26 which in the embodiment shown herein is diagonal to the wall surface 16. By running downwards to the wall surface 16, on one hand space is created on the upper edge of the pan for a plug-in union or nozzle 27 and a perforation 28 which connects the plug-in union 27 to the inside of the pan 17 and on the other hand, the weakening of the layer of insulation material 43 surrounding the container 15 by the backing piece 14 is minimized. One end of the pipe 13 is anchored in the plug-in union 27 and hermetically sealed by using an insertion cartridge 29.

Figure 3:
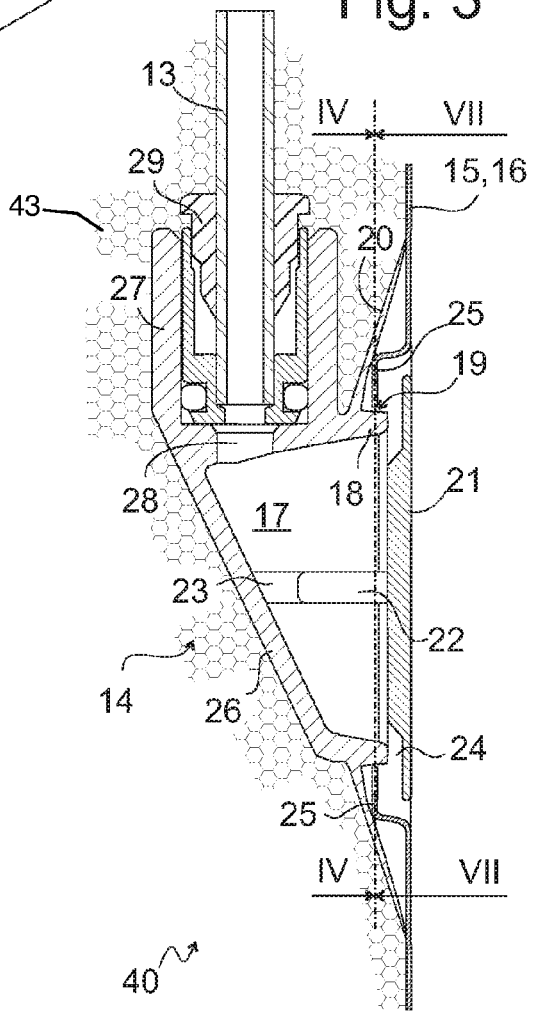
FIG. 3 is a vertical-sectional view of the backing piece.
Figure 4:
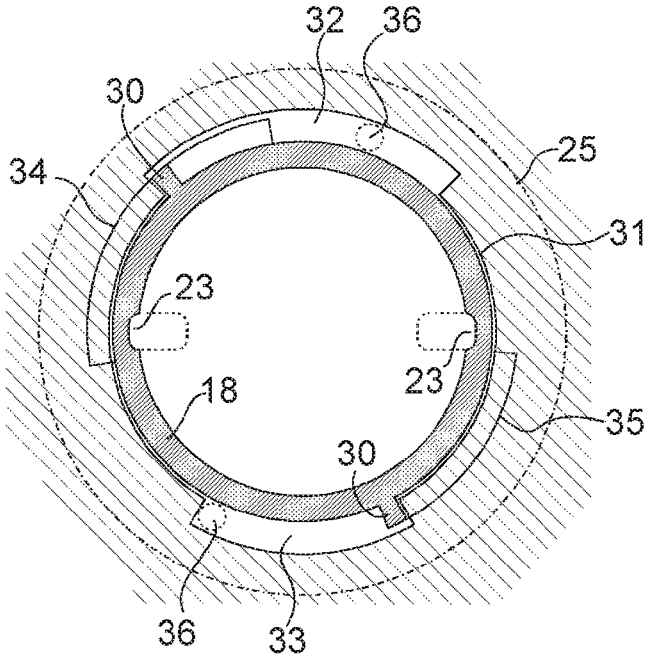
FIG. 4 is a cross-sectional view taken along a plane IV-IV of FIG. 3 looking toward the storage chamber.

FIG. 4 shows a cross section along the plane identified by numerals IV-IV in FIG. 3. The pipe section 18 is circular on the intersecting plane, apart from the two grooves 23 on its internal side and two striker ribs 30 extending in an axial direction transversely to the intersecting plane on its external side. The opening 19 includes a circular central area 31 which houses the pipe section 18 with a narrow clearance, and two diametrically opposed protrusions 32, 33, each in the form of circular segments with the same radius but different angular extension, in which the striker ribs 30 engage.

Two crosspieces 34, 35 radially protruding from the pipe section 18 and elongated in its peripheral direction are formed beyond the intersecting plane of FIG. 4, on the edge of the pipe section 18 facing the storage chamber 3. The crosspieces 34, 35 are measured in such a way that they can pass the protrusions 32, 33 in the appropriate direction of the backing piece 14 if the pipe section with its longitudinal axis perpendicular to the wall surface 16 is pushed through the opening 19. Then the backing piece 14 is rotated around its axis until the striker ribs 30 strike one edge of the opening 19, i.e. as far as the direction shown in FIG. 4. The crosspieces 34, 35 together with the border area 25 thus form a bayonet coupling which in this position locks the backing piece 14 to the inner container wall 15 by overlapping the crosspieces 34, 35 with the border area 25.

Due to the different dimensions of the protrusions 32, 33 or crosspieces 34, 35, there is only one direction in which the backing piece 14 can be inserted into the opening 19 so that the end position shown in FIG. 4 is also clearly established. In this position the plug-in union 27 (not shown in FIG. 4) points upwards so that foreign material from the pan 17 cannot enter into the pipe 13.

Appropriate construction of the cover 21 enables the backing piece 14 to be completely immobilized in the direction shown in FIG. 4, even before the layer of foam is formed around the inner container 15. For example, in addition to the pins 22, the cover 21 may have at least one pin 36 extending beyond the pan 17 which engages in one of the protrusions, in this case the protrusion 33, at the end opposite the striker rib 30. FIG. 4 also shows a second pin 36 which engages in the protrusion 32 diametrically opposed to the first pin 36. The second pin 36 has no function in the protrusion 32, its benefit is that in both directions in which the cover 21 can be placed on the backing piece 14, a pin 36 engages in the protrusion 33 and thus prevents the rotation of the backing piece 14.

Figure 5:
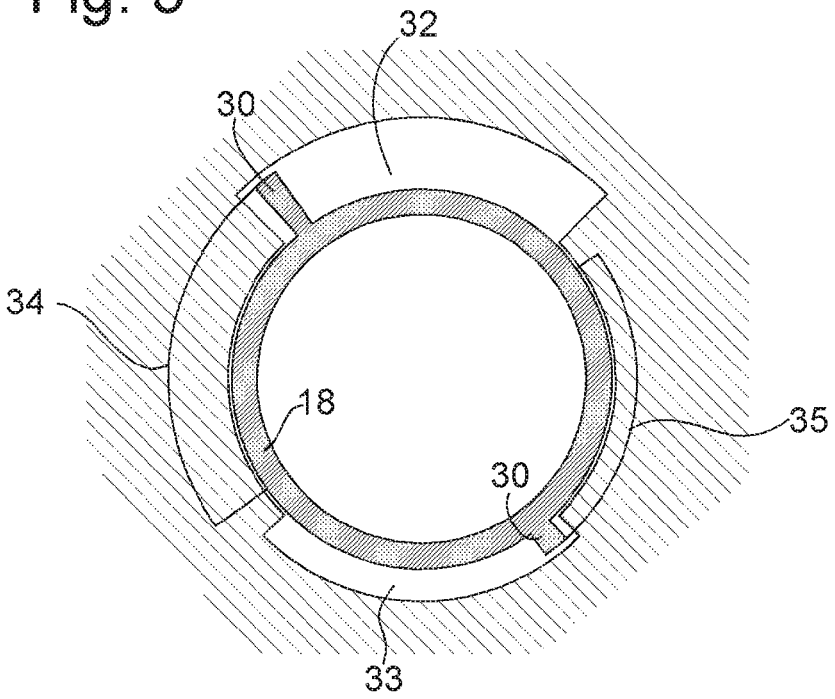
FIG. 5 is a cross-sectional view analogous to FIG. 4 according to a second embodiment.

FIG. 5 shows a cross section analogous to FIG. 4 according to a second embodiment which differs from the embodiment of FIG. 4 as a result of the dimensions of the protrusions 32, 33 and crosspieces 34, 35. In the embodiment of FIG. 5 all of the protrusions 32, 33 and crosspieces 34, 35 extend over an equal angle, but different radii from the protrusion 32 and the crosspiece 34, on one hand, and the protrusion 33 and the crosspiece 35, on the other hand, ensure that the backing piece 14 can only be installed in a single direction on the inner container wall 15.

In the embodiments of FIGS. 4 and 5, each of the gaps between the crosspieces 34, 35 on the circumference of the pipe section 18 are the same size. It would also be conceivable to ensure that the backing piece 14 could only be installed in a single direction on the wall surface 16 as a result of these gaps being of different sizes.

Figure 6:
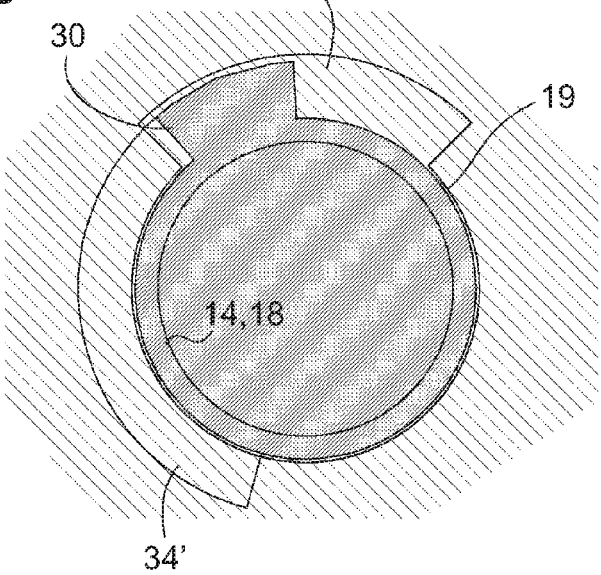
FIG. 6 is a cross-sectional view analogous to FIG. 4 according to a third embodiment.

FIG. 6 shows a third embodiment with only a single protrusion 32' at the opening 19 and a single crosspiece 34' on the backing piece 14. The angular extension of the crosspiece 34' is significantly greater than that of the protrusion 32', it is therefore not possible to push the pipe section 18 through the opening 19 in a straight path with the longitudinal axis perpendicular to the wall surface 16, rather installation is only possible by using a screw movement in which the border area 25, where it overlaps with the crosspiece 34', is elastically deflected temporarily. If the border area 25 relaxes again after reaching the position shown in FIG. 6, in this way latching of the backing piece 14 is achieved simultaneously, ensuring that the upwards orientation of the plug-in union 27 cannot be lost again before the creation of the foam layer.

Figure 7:
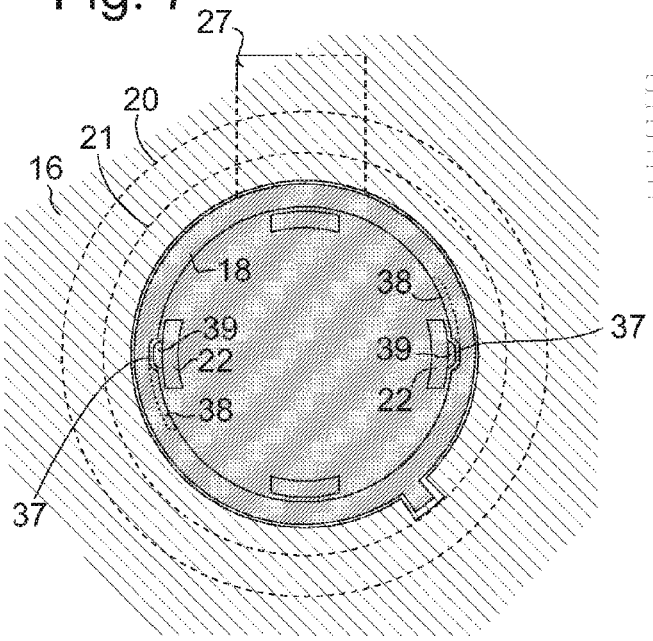
FIG. 7 is a cross-sectional view according to a fourth embodiment, which is taken along the same plane as in FIG. 4, but looking from the storage chamber.

FIG. 7 shows a further embodiment of the invention in a cross section along the same plane as in FIGS. 4 to 6, but looking in the opposite direction, from the storage chamber 3 to the outside, which is why in this diagram the apron 20 and the plug-in union 27 are also visible as dotted outlines which, although in the line of vision, are concealed behind the wall surface 16. The pan 17 has grooves 37 extending in an axial direction, similar to the grooves 23 in FIG. 3, to which grooves 38 running in a peripheral direction at the level of the bottom of the pan, beyond the intersecting plane of FIG. 7, connect. Pins 22 of the cover 21 engaging in the pan 17 have nubs 39 which are still in the grooves 37 in the diagram in FIG. 7, but by turning the cover anticlockwise can be inserted into the grooves 38 so that through the resulting bayonet locking of the cover 21 on the backing piece 14 this is form-lockingly anchored to the inner container wall 15.

Figure 8:
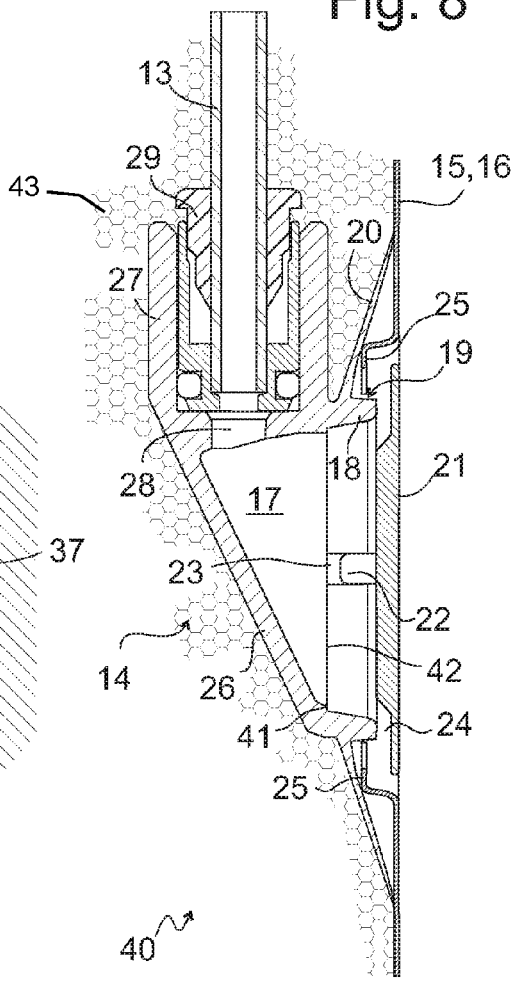
FIG. 8 is a vertical-sectional view analogous to FIG. 3 according to a fifth embodiment.

The embodiment of the connection housing 40 shown in FIG. 8 differs from that of FIG. 3 in that an inwards projecting shoulder 41 is formed in the pipe section 18 of the backing piece to which a membrane 42 covering the entire cross section of the pan 17 is fastened by bonding, welding or the like. The membrane 41 may be airtight but made of a slightly stretchy rubber-elastic material or be flexible so that it does not offer any appreciable resistance significantly influencing the measurement result of the pressure sensor 12 to the displacement of a small amount of air due to a change in pressure in the storage chamber 3. The use of a membrane 42, which is permeable for gases but not for liquids and particles, is also conceivable. Behind the cover 21, the membrane 42 is securely protected from damage by foreign bodies and for its part protects the pipe 13 from the penetration of water or dirt, even if the pipe does not pass upwards from the backing piece 14.

The invention claimed is:

1. A refrigeration appliance or domestic refrigeration appliance, comprising:

an inner container having a wall surface and a border area being sunk into said wall surface, said inner container delimiting a storage chamber;

a pressure sensor disposed outside said storage chamber;

a door opening aid controlled by said pressure sensor;

a connection housing anchored in an opening formed in said wall surface of said inner container, said opening being surrounded by said border area;

said connection housing providing communication between said pressure sensor and said storage chamber;

said connection housing including a cover;

said connection housing having an exposed surface being part of said cover, said exposed surface facing said storage chamber and being flush with a surrounding part of said wall surface; and said border area and said cover defining a gap providing communication between said pressure sensor and said storage chamber.

2. The refrigeration appliance according to claim 1, which further comprises a layer of insulation material surrounding said inner container, said pressure sensor being disposed outside said layer of insulation material.

3. The refrigeration appliance according to claim 1, which further comprises a deflectable membrane dividing said connection housing into a pressure sensor part and an inner container part.

4. The refrigeration appliance according to claim 1, which further comprises a layer of insulation material surrounding said inner container, said connection housing including a backing piece engaging in said layer of insulation material, and a pipe connected to said backing piece and communicating with said pressure sensor.

5. The refrigeration appliance according to claim 4, wherein said pipe emanating from said backing piece extends upwards.

6. The refrigeration appliance according to claim 4, wherein said backing piece has a nozzle, and an insertion cartridge fastens said pipe to said nozzle.

7. The refrigeration appliance according to claim 4, wherein said inner container has an external side, and said backing piece has a peripheral apron being elastically deformed in contact with said external side of said inner container.

8. The refrigeration appliance according to claim 1, which further comprises a bayonet coupling anchoring said connection housing in said opening.

9. The refrigeration appliance according to claim 8, wherein:

said opening includes a circular central area;

said connection housing includes a cylindrical pipe section extending through said circular central area;

said bayonet coupling includes a crosspiece protruding radially outwardly from said pipe section and extending in a peripheral direction of said pipe section; and at least one protrusion is provided through which said crosspiece can be passed to overlap with said border area when said bayonet coupling is in a locked position.

10. The refrigeration appliance according to claim 9, wherein said crosspiece is one of at least two crosspieces of said bayonet coupling protruding radially outwardly from said cylindrical pipe section and being separated from each other by gaps in a peripheral direction, said crosspieces having different dimensions in at least one of a radial direction or a peripheral direction or said gaps having different dimensions in a peripheral direction.

11. The refrigeration appliance according to claim 10, wherein said at least one protrusion includes at least two protrusions in said opening, at least one of said at least two protrusions being dimensioned to only allow one of said two crosspieces through in a direction of a longitudinal axis of said pipe section.

* * * * *